US005367968A

United States Patent [19]

Diaz

[11] Patent Number: 5,367,968

[45] Date of Patent: Nov. 29, 1994

[54] METHOD AND APPARATUS FOR SEWING UPHOLSTERED FURNITURE

[75] Inventor: Enrique Sachristan D. Diaz, Madrid, Spain

[73] Assignee: Fabricas Lucia Antonio Betere, S.A., Madrid, Spain

[21] Appl. No.: 934,456

[22] PCT Filed: Jan. 2, 1992

[86] PCT No.: PCT/ES92/00001

§ 371 Date: Oct. 28, 1992

§ 102(e) Date: Oct. 28, 1992

[87] PCT Pub. No.: WO92/12282

PCT Pub. Date: Jul. 23, 1992

[30] Foreign Application Priority Data

Jan. 10, 1991 [ES] Spain ..... 9100056

[51] Int. Cl.[5] ..... D05B 11/00; D05B 27/00

[52] U.S. Cl. ..... 112/262.3; 112/2.1; 112/304; 112/309

[58] Field of Search ..... 112/2.1, 10, 303, 304, 112/309, 121.12, 262.1, 262.3

[56] References Cited

U.S. PATENT DOCUMENTS

| | | | |
|---|---|---|---|
| 2,939,414 | 6/1960 | Slinn | 112/204 |
| 3,072,081 | 1/1963 | Milligan et al. | 112/2 |
| 3,421,463 | 1/1969 | Happe et al. | 112/77 |
| 3,911,840 | 10/1975 | Marforio | 112/153 |
| 3,970,017 | 7/1976 | Babson et al. | 112/121.12 |
| 4,722,290 | 2/1988 | Manuel et al. | 112/153 |
| 4,838,186 | 6/1989 | Resta et al. | 112/2.1 |
| 4,928,609 | 5/1990 | Kawasaki | 112/121.12 |
| 4,958,579 | 9/1990 | De Weers | 112/2.1 |
| 4,996,931 | 3/1991 | Mall | 112/121.12 |
| 5,018,462 | 5/1991 | Brocklehurst | 112/121.12 |
| 5,216,969 | 6/1993 | Thomas et al. | 112/121.27 X |

FOREIGN PATENT DOCUMENTS

| | | |
|---|---|---|
| 330285 | 8/1989 | European Pat. Off. . |
| 507412 | 9/1920 | France . |
| 3521559 | 12/1986 | Germany . |

*Primary Examiner*—Clifford D. Crowder
*Assistant Examiner*—Paul C. Lewis
*Attorney, Agent, or Firm*—Peter L. Michaelson; Jeffrey J. Brosemer

[57] ABSTRACT

Apparatus and a concomitant method for sewing seams in upholstered furniture such as mattresses. The apparatus contains a sewing machine located adjacent a conveyor belt which moves the mattress in a linear direction beneath the sewing machine, a presser arm for turning the mattress, and a fastening cylinder for temporarily attaching the mattress to the presser arm during the turning process. A single motor drives the sewing machine, the conveyor belt and the presser arm. As the mattress is moved by the conveyor belt at a first speed, the sewing machine sews a linear portion of a seam in the mattress. A sensor indicates when a corner of the mattress approaches the sewing machine. When the sensor indicates the approach of the corner, the conveyor belt is halted and the motor changes to a slower speed such that the sewing speed is slowed. Simultaneously, the fastening cylinder temporarily attaches a presser arm to the mattress. The presser arm is then rotated about a pivot that is located adjacent the conveyor belt. The presser arm rotation turns the mattress about its corner while the sewing machine sews a corner portion of the seam in the mattress. Consequently, the rectilinear portion and the corner portion form a continuous seam. Once the corner portion is sewn, the conveyor belt is again activated and the motor speed is increased to the first speed such that the sewing machine sews another rectilinear portion of the seam.

7 Claims, 2 Drawing Sheets

METHOD AND APPARATUS FOR SEWING UPHOLSTERED FURNITURE

BACKGROUND OF THE INVENTION

1. Field of the invention

The present invention relates to a process and apparatus for sewing upholstered furnitures and more particularly, the invention is a system for sewing workpieces such as mattresses or the like, which contains notable advantages and innovations over the sewing systems actually used in the market.

2. Description of the Prior Art

Presently there are known several electromechanical devices and processes used for accomplishing semi-automatic sewing of upholstered furnitures. Unfortunately, each of these prior art systems are excessively complex, suffer frequent breakdown and result in high costs. Additionally, using the prior art systems, the corners of the mattresses or the like cannot be satisfactorily sewn. Unsatisfactorily sewing the corners, reduces the quality of the sewing and considerably increases the time of work and the consequential expenses.

SUMMARY OF THE INVENTION

For the purpose of avoiding the disadvantages associated with the prior art, the process and apparatus for sewing upholstered furniture that is the subject of the present invention was created. The invention, being of simple constitution and easy working, reduces costs and satisfactorily solves the technical defects of the prior art sewing devices. Specifically, the present invention teaches adequate means for sewing the corners of mattresses or the like with a continuity with respect to the rest of the same, thus obtaining a perfect quality of the sewing finish of the mattresses in addition to notably reduced work time.

The proposed method and apparatus (machine) for sewing upholstered furniture involves a set of components including a movable support, a sewing machine, a rotating arm and suitable fastening means to attach the mattress to the movable support. All this is suitably arranged in order to sew the mattress through electromechanical means. As a novelty, only one motor equipped with a speed regulator is provided. This motor moves the above-mentioned components by means of a transmission system, so that it is possible to sew the rounded edges of a mattress or similar continuously with the rest of the edges of the mattress.

The described machine only sews when the operator actuates a pushbutton, preferably a pedal provided for this purpose. This machine is equipped for sewing at two speeds; the faster speed is used for rectilinear sewing and the slower speed, which automatically starts up, is used at the end of a rectilinear seam, specifically, the slower speed is activated before coming to the curve. In particular, the slower speed is used for sewing the curved seams of the mattress.

Additionally, the machine is equipped with photoelectric cells; one of them is provided approximately 150 mm from the end of the rectilinear seam and provides a signal which causes the slow sewing speed to begin. The other cell is located some 75 mm from the end of the rectilinear mattress seam, signaling the mattress to turn and to be sewn at the slow speed along the curved seam.

BRIEF DESCRIPTION OF THE DRAWINGS

The following detailed description of the invention refers to the attached figures in which the execution deemed suitable and in accordance with the preceding comment has been shown by way of example and thus a purely unrestrictive nature, since in practice some slight modifications may be advisable that do not alter the essence of the invention.

In the drawings.

DETAILED DESCRIPTION

Figure 1:
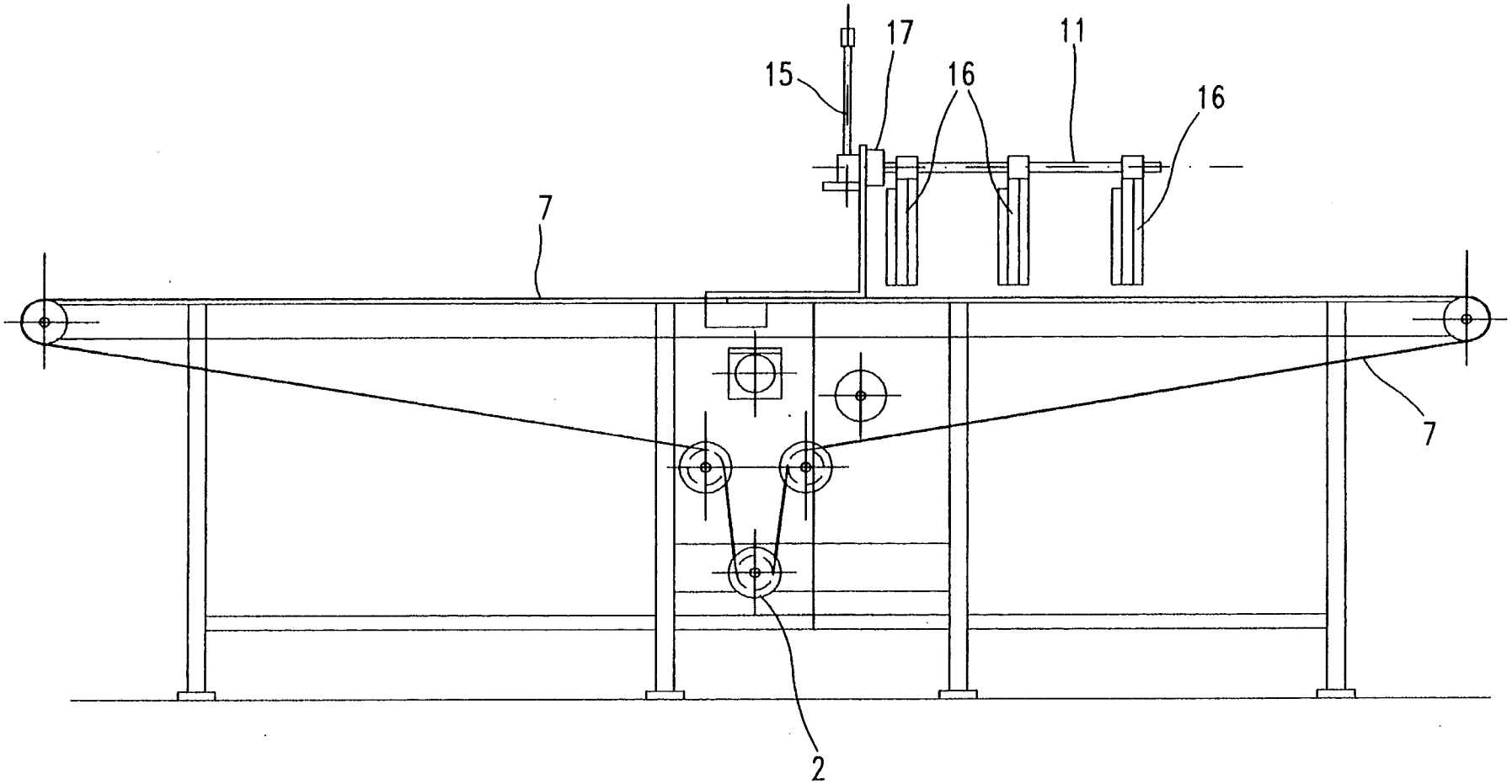
FIGS. 1 and 2 are elevated and cross-sections, respectively, of the machine.
Figure 2:
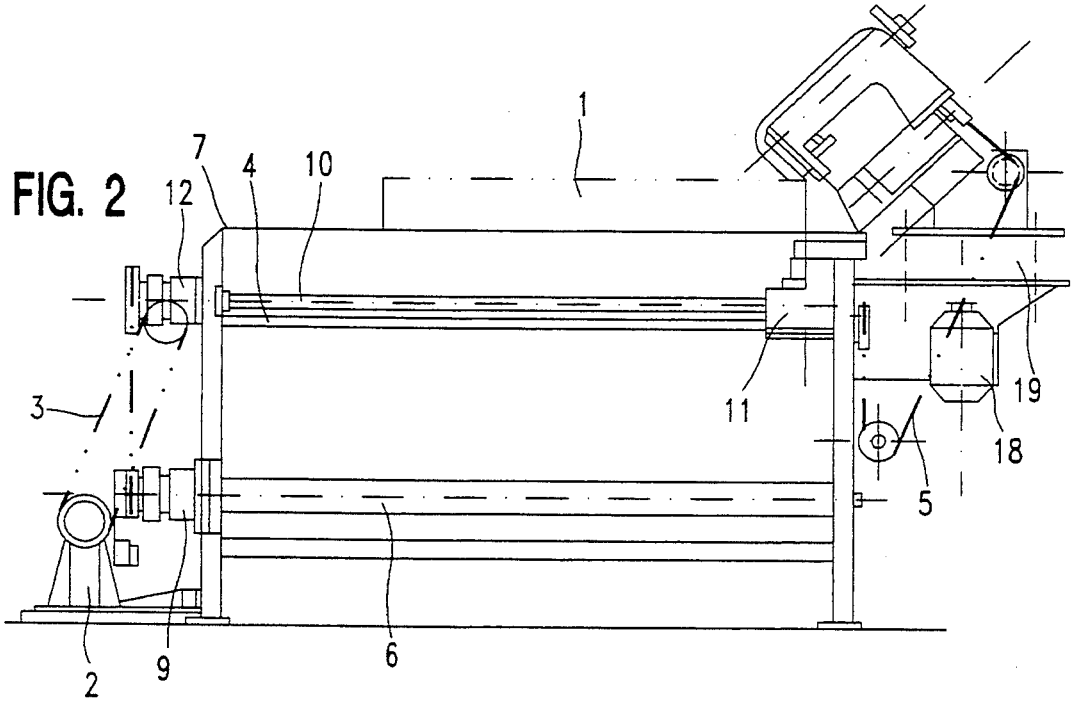
Figure 3:
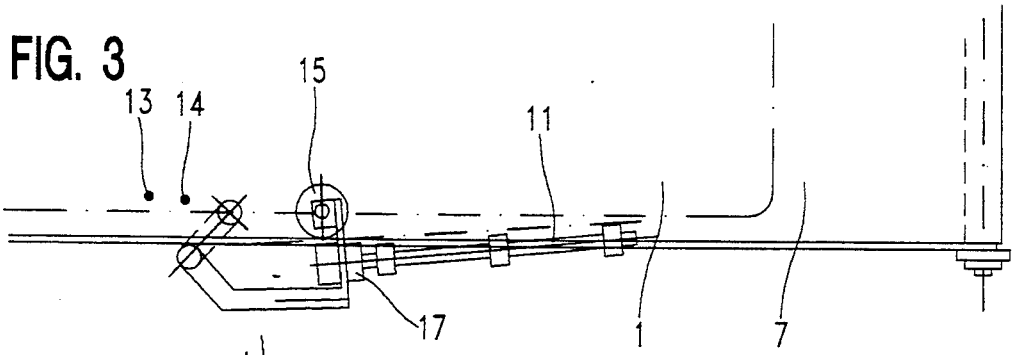
FIGS. 3 and 4 represent partial plan views of the machine in which different phases of the sewing operation are shown.
Figure 4:
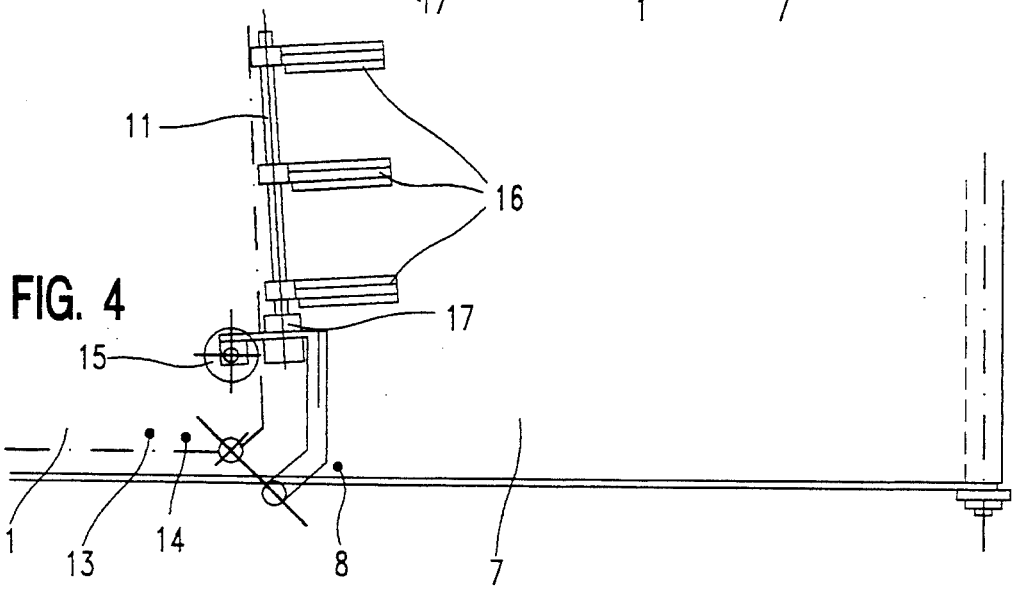

Referring to the attached figures, their execution shows a machine for sewing upholstered furniture such as mattresses 1. This machine works only when the operator actuates a pushbutton, preferably pedal type, that starts up the reducer motor with speed regulator 2. The reducer motor moves, via the transmission 3 and the shaft 4, the sewing head transmission 5.

Simultaneously, the motor 2 moves the shaft 6 for the conveyor belt 7. The speed of the conveyor belt is synchronized with the stitch speed of the sewing machine by means of a mechanical system; the above-mentioned shaft 6 is equipped with a pneumatic clutch 9.

Furthermore, the motor 2 also transmits movement to the shaft 10 to move the presser 11; this shaft 10 is also equipped with a pneumatic clutch 12.

Sewing is usually begun on one side of the mattress 1, driving the conveyor belt 7 to the latter at a relatively fast speed until the curve in the mattress is reached by the sewing head of the sewing machine.

The speed is reduced when sensor 13 is exposed, and when sensor 14 is exposed. Consequently, the fastening cylinder 15 is simultaneously lowered. Additionally, clutch 9 starts operating which stops the conveyor belt 7, and the presser 11 starts moving by means of clutch 12.

During the turn, the curved seam of the mattress 1 is sewn at a relatively slow speed while motion of the conveyor belt 7 is halted. When the mattress 1 has been rotated 90 degrees by presser 11, sensor 8 is actuated, which sends a signal that raises the fastening cylinder 15. Additionally, the presser blades 16 rotate by means of a rotation actuator 17 that starts up the conveyor belt 7 at the fast speed and simultaneously reverses the presser 11; thus it is not necessary to wait for the latter to reverse, since when the presser blades 16 rotate, they clear the way for the mattress 1 to move along with the conveyor belt in a rectilinear direction. This cycle is repeated at each corner.

When the perimeter of the mattress is completely sewn, the operator releases the pushbutton and stops the motor in a sequence such that the sewing needle is folded up into the head by a system provided for this purpose.

When sewing the first side of the mattress 1, the height of the head in relation to the conveyor belt 7 should be greater than when sewing the second side. Thus, after turning round the mattress, the operator should actuate a motor 18 in order to modify this distance 19.

Having described this invention, it is hereby declared that the following claims are new and the claimant's own invention:

1. Apparatus for sewing a seam in upholstered furniture, wherein said seam contains a rectilinear portion and a curved portion, said apparatus comprising:

sewing means for sewing a seam in upholstered furniture;

supporting means for supporting and moving the upholstered furniture beneath said sewing means as said seam is sewn;

motor means, connected to said supporting means, for moving said supporting means at a first pre-defined speed while said rectilinear portion of said seam is sewn at a first pre-defined sewing speed and for halting movement of said supporting means while said curved portion of said seam is sewn at a second pre-defined sewing speed;

presser means, located adjacent said supporting means, for turning said upholstered furniture such that said curved portion of said seam is sewn by said sewing means, wherein said presser means comprises;

an actuator;

an elongated rod having a first end and a second end, said elongated rod being connected to said actuator by said first end such that activation of said actuator rotates said elongated rod;

a plurality of presser blades, connected to said elongated rod between said first and second ends thereof, that rotate, in response to activation of said actuator, from a first blade position to a second blade position, wherein said first blade position places said blades adjacent said furniture and perpendicular to a plane formed by said supporting means and said second blade position is parallel to said plane; and pivoting means, connected to said actuator, for rotating said actuator, elongated rod and presser blades from a first presser position that is parallel to a direction of motion of said supporting means to a second presser position that is transverse said direction of motion of said supporting means, whereby such rotation turns said upholstered furniture while said sewing means sews said curved portion of the seam;

fastening means, connected to said presser means, for temporarily attaching said presser means to said upholstered furniture while said upholstered furniture is turned by said presser means; and sensing means, located adjacent said supporting means, for indicating a position of said upholstered furniture and for activating, in response to said position, said presser means and said fastening means to turn said upholstered furniture and for halting movement of said supporting means while said upholstered furniture is turned.

2. The apparatus of claim 1 wherein said first pre-defined speed is faster than said second pre-defined speed.

3. The apparatus of claim 1 wherein said supporting means is a conveyor belt.

4. The apparatus of claim 1 wherein said sensing means further comprises a photoelectric cell for detecting the position of said upholstered furniture such that a control signal is produced that indicates the passage of a corner of said furniture over said photoelectric cell, wherein said control signal activates said fastening means and presser means and halts movement of the supporting means.

5. A method for sewing a seam in upholstered furniture, where said seam contains a rectilinear portion and a curved portion, said method comprising the steps of:

sewing said rectilinar portion of said seam in said upholstered furniture at a first pre-defined sewing speed while moving said upholstered furniture in a rectilinear direction at a pre-defined speed;

sensing a position of a corner of said upholstered furniture;

changing, upon sensing said corner, said sewing speed from said first pre-defined sewing speed to a second pre-defined sewing speed;

halting said motion of said upholstered furniture, and activating a fastening cylinder to temporarily attach a presser arm to said upholstered furniture, wherein the presser arm comprises:

an actuator;

an elongated rod having a first end and a second end, said elongated rod being connected to said actuator by said first end such that activation of said actuator rotates said elongated rod;

a plurality of presser blades, connected to said elongated rod between said first and second ends thereof, that rotate, in response to activation of said actuator, from a first blade position to a second blade position, wherein said first blade position places said blades adjacent said furniture and perpendicular to a plane formed by a conveyor belt that moves said upholstered furniture in said rectilinear direction and said second blade position is parallel to said plane; and a pivot, connected to said actuator, for rotating said actuator, elongated rod and presser blades from a first presser position that is parallel to a direction of motion of said conveyor belt to a second presser position that is transverse said direction of motion of said conveyor belt, whereby such rotation turns said upholstered furniture while said sewing means sews said curved portion of the seam; and said method further comprises the steps of:

turning said upholstered furniture by rotating said presser arm to turn said upholstered furniture while said corner is sewn at said second pre-defined sewing speed to produce said curved portion of said seam, wherein said turning step comprises the steps of:

rotating, about said pivot, said actuator, elongated rod and presser blades from said first presser position to said second presser position to turn said upholstered furniture;

activating, once said upholstered furniture is turned, said actuator to rotate said presser blades from said first blade position to said second blade position such that said upholstered furniture may pass beneath said presser arm;

rotating, after said conveyor belt begins moving said upholstered furniture, said actuator, elongated rod and presser blades from said second presser position to said first presser position; and activating said actuator to rotate said presser blades from said second blade position to said first blade position;

changing, upon completing said curved portion of said seam, said sewing speed from said second pre-defined sewing speed to said first pre-defined sewing speed; and moving said upholstered furniture in a rectilinear direction while said rectilinear portion of said seam is sewn.

6. The method of claim 5 wherein said first pre-defined sewing speed is faster than said second pre-defined sewing speed.

7. The method of claim 5 wherein said turning step further comprises the step of turning the upholstered furniture ninety degrees.

* * * * *